US007150453B1

(12) United States Patent
Werner

(10) Patent No.: US 7,150,453 B1
(45) Date of Patent: Dec. 19, 2006

(54) OSCILLATOR FOR STAGGERING SHEETS

(75) Inventor: Todd C Werner, St. Petersburg Beach, FL (US)

(73) Assignee: Pitney Bowes Inc., Stamford, CT (US)

( * ) Notice: Subject to any disclaimer, the term of this patent is extended or adjusted under 35 U.S.C. 154(b) by 349 days.

(21) Appl. No.: 10/709,017

(22) Filed: Apr. 7, 2004

(51) Int. Cl.
*B65H 5/22* (2006.01)

(52) U.S. Cl. ..... 271/3.01; 271/146; 271/241

(58) Field of Classification Search ..... 271/146, 271/147, 165, 210, 3.01, 3.02, 3.05, 133, 271/241, 220, 221, 184, 225
See application file for complete search history.

(56) References Cited

U.S. PATENT DOCUMENTS 3,705,719 A * 12/1972 Polit et al. ..... 271/3.03
3,776,544 A * 12/1973 Watson et al. ..... 271/3.03
4,081,181 A * 3/1978 Crowe et al. ..... 271/3.01
6,601,841 B1 * 8/2003 Werner ..... 271/3.01
6,695,304 B1 2/2004 Werner

* cited by examiner

*Primary Examiner*—Patrick Mackey
*Assistant Examiner*—Kaitlin Joerger
(74) *Attorney, Agent, or Firm*—Michael J. Cummings; Steven J. Shapiro; Angelo N. Chaclas

(57) ABSTRACT

The trailing ends of envelopes stacked vertically in a hopper are tapped by jostling members that oscillate in a horizontal plane. The tapping action breaks frictional bonds between contiguous items. The jostling members are mounted on a base plate that is adjustably mounted in overlying relation to a floor plate of the hopper to accommodate items of varying widths. A cam and cam follower arrangement causes oscillation of the floor plate and hence of the base plate and the jostling members. The jostling members may take the form of acute or right angle members, wheels, or the like.

7 Claims, 4 Drawing Sheets

OSCILLATOR FOR STAGGERING SHEETS

BACKGROUND OF INVENTION

1. Field of the Invention

This invention relates, generally, to high-speed paper-handling machines. More particularly, it relates to an oscillator that rapidly taps items along their respective trailing edges as they are fed into a hopper.

2. Description of the Prior Art

Whenever items in a stack are removed one at a time from the bottom of the stack, the items often fail to advance toward the bottom of the stack under the influence of gravity as the lowermost item is removed. The items in the stack are easily stuck to the walls of the bin or hopper within which they are stacked. In the absence of a mechanical jostling means it is necessary for a human operator to jostle the stack to cause the items to fall. This creates problems because the vacuum shuttle feed at the bottom of the stack, or other item-removing means such as a spinning frictional belt, are required to operate under varying loads if the stack does not move downwardly in a uniform manner during machine operation. Varying loads prevent the item-removing means from operating in an optimal manner.

The prior art most relevant to the present invention is disclosed in U.S. Pat. No. 6,695,304 entitled "Vibrating Means For Aligning Envelopes In A Hopper" to the present inventor. In that inventive structure, a wedge-shaped member positioned at the bottom of an envelope hopper oscillates under the control of a friction shuttle feed so that it lifts and drops an edge of the envelopes with each reciprocation, thereby breaking the frictional bonds between contiguous envelopes. The entire stack of envelopes bounces during oscillation of the wedge-shaped member. This jostling is desirable because it breaks said frictional bonds between contiguous items and it helps stagger the sheets as they exit the hopper.

A vacuum shuttle feed is quite reliable but a vacuum must be turned on and off quickly as the shuttle reciprocates. When an item at the bottom of a stack is ready to be discharged therefrom, the vacuum is turned on, i.e., the item is exposed to a vacuum, and the shuttle moves forwardly to remove the item from the bottom of the stack. A gate at the leading end of the apparatus blocks an item on top of the bottom item from being carried forward by the shuttle. The vacuum is then turned off until the shuttle returns to the bottom of the stack.

The earlier design does not work well when the items being introduced into a hopper are warped because such warping can defeat the grabbing action of the vacuum. Warped items are not uncommon.

There is a need, therefore, for an item-jostling apparatus that does not require a vacuum shuttle feed. The needed apparatus would have utility even when the items being fed into or removed from a hopper are warped.

The needed apparatus should also stagger the items as the items approach a separator.

However, in view of the prior art considered as a whole at the time the present invention was made, it was not obvious to those of ordinary skill in the pertinent art how the identified needs could be fulfilled.

SUMMARY OF INVENTION

The long-standing but heretofore unfulfilled need for an improved structure for breaking frictional bonds between items stacked in a hopper, for staggering those items as they approach a separator, and for keeping the items in the stack from becoming stuck in the hopper so that a uniform pressure is maintained on the hopper-emptying means is now met by a new, useful, and non-obvious invention.

The novel apparatus includes a floor plate for supporting the items in the hopper. The floor plate is disposed in a substantially horizontal plane and has a leading end and a trailing end. A base plate, also having a leading end and a trailing end, overlies the floor plate and is fixedly secured to the floor plate for conjoint movement therewith. At least one jostling member is formed integrally with the base plate.

Although the at least one jostling member may be provided in a plurality of shapes, in the preferred embodiment it includes an angled member that includes a horizontal part having a leading and a trailing end that is secured to the base plate and an upwardly angled part formed integrally with the leading end of the base plate. The upwardly angled part is disposed at a predetermined angle relative to the horizontal plane defined by the base plate.

Oscillating means are secured to the floor plate to cause the floor plate and hence the base plate and the at least one jostling member to oscillate in the substantially horizontal plane. The oscillation breaks frictional bonds between contiguous items because the at least one jostling member taps the respective trailing edges of the items during the forward motion phase of each oscillation. This simulates a human tapping the trailing edges of the items in the stack.

Accordingly, the items do not stick to the walls of the bin or hopper and they steadily advance to the bottom of the stack as items are removed from said bottom by an item-removing means in a sequential manner. Thus, a steady, uniform load is applied to the item-removing means positioned at the bottom of the hopper. The shape of the jostling means also serves to stagger the respective leading edges of the items, with the leading edge of a lowermost item disposed in leading relation to the leading edge of the contiguous item above it, as they exit the hopper and approach a separator means because the uppermost end of the at least one jostling member is disposed in trailing relation to the lowermost end of the at least one jostling member.

In an illustrative embodiment of the invention, a first conveyor means delivers the items to the hopper along a first path of travel, A second conveyor means carries items from the hopper along a second path of travel disposed substantially ninety degrees (90°) to the first path of travel. The leading end and the trailing end of the floor plate are substantially parallel to the first path of travel and substantially transverse to the second path of travel. The oscillating means oscillates the floor plate and hence the at least one jostling member in a direction substantially transverse to the first path of travel and substantially parallel to the second path of travel.

An adjustably mounted barrier means extends into the hopper in a direction transverse to the first path of travel so that the hopper may accommodate items of differing lengths. More particularly, an elongate rod is disposed in substantially parallel relation to the first path of travel and a mounting block is slideably mounted along the extent of the elongate rod. A rigid barrier arm is mounted to the block and extends from the block in substantially parallel relation to the second path of travel. A locking means locks the mounting block at any preselected position along the extent of the elongate rod. The rigid barrier arm is moved a preselected distance toward the first conveyor means to accommodate items of relatively short length and the rigid barrier arm is moved a preselected distance away from the first conveyor means to accommodate items of longer extent.

Width adjusting means are provided so that the hopper accommodates items of differing widths entering the hopper from the first conveyor means. More particularly, an elongate slot is formed in the floor plate in substantially parallel relation to the second path of travel. The base plate with which said at least one jostling member is integrally formed is lockable into position at any preselected location along the length of the elongate slot. The base plate and hence the at least one jostling member is moved a preselected distance toward the second conveyor means to accommodate items of relatively narrow width and is moved a preselected distance away from the second conveyor means to accommodate items of greater width.

The oscillating means may take any suitable form but in a preferred embodiment the structure includes a biasing means housing fixedly secured to the floor plate. The biasing means housing has a closed end and an open end. A biasing means is disposed within the biasing means housing. A cam follower housing is fixedly secured to the floor plate and the biasing means is disposed in abutting relation to the cam follower housing, urging the cam follower housing away from the biasing means housing. A cam follower is rotatably mounted in the cam follower housing. A cam is eccentrically mounted to a drive shaft for conjoint rotation therewith. The biasing means urges the cam follower into abutting relation to the cam so that rotation of the cam effects oscillation of the cam follower housing and hence of the floor plate, the base plate and the at least one jostling member.

An important object of this invention is to reduce downtime in paper-handling machines by reducing downtime associated with jamming of stacked items as they are sequentially removed from a hopper.

Another object is to improve separation of contiguous paper items by breaking frictional bonds between them as they enter and exit a hopper.

Another object is to provide a jostling apparatus that works even when the items in the hopper are warped.

Still another object is to provide a jostling apparatus that staggers the items as they approach a separator.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1:
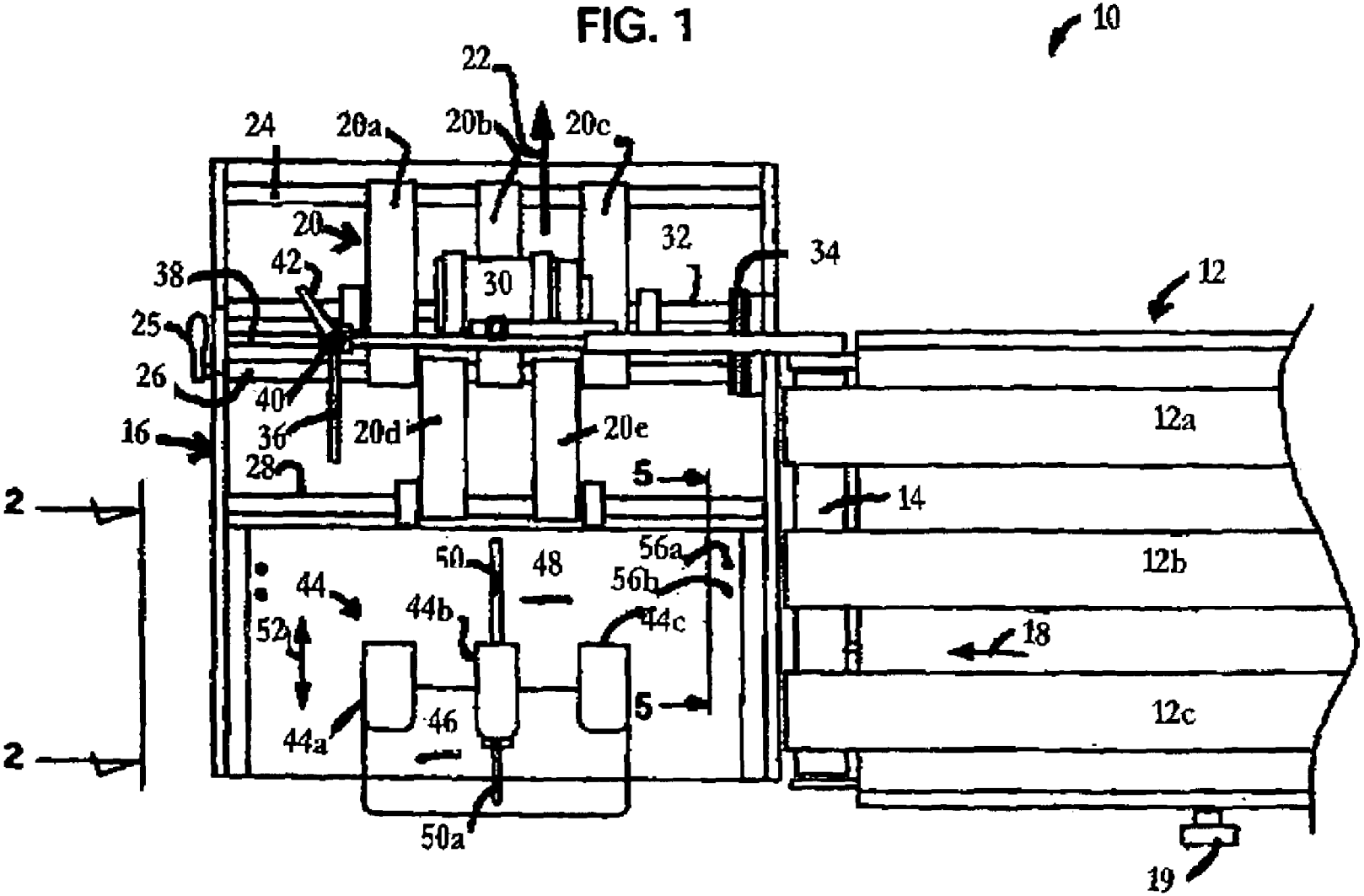
FIG. 1 is a top plan view of a hopper that is fed by a conveyor.

Referring to FIG. 1, it will there be seen that the reference numeral 10 denotes an illustrative embodiment of the present invention as a whole.

Elongate conveyor means 12 which in this particular example includes parallel belts 12*a*, 12*b*, and 12*c* that wrap around transversely disposed roller 14 at their respective leading ends, continuously delivers items such as envelopes, not shown, to hopper 16, as indicated by single-headed directional arrow 18. Conveyor-length control knob 19 forms no part of this invention.

Hopper 16 includes a hopper conveyor means 20 disposed at a substantially ninety-degree (90°) angle to conveyor means 12, said hopper conveyor means in this particular example including conveyor belts 20*a*, 20*b*, 20*c*, 20*d*, and 20*e*. Accordingly, items (not shown) exiting hopper 16 follow a path of travel denoted by single-headed directional arrow 22.

The respective leading ends of conveyor belts 20*a*, 20*b*, and 20*c* are wrapped around driven shaft 24 and their respective trailing ends are wrapped around drive shaft 26. The respective leading ends of conveyor belts 20*d* and 20*e* are wrapped around drive shaft 26 and their respective trailing ends are wrapped around driven shaft 28. The output shaft (not shown) of motor 30 is coupled to shaft 32 which is connected to drive shaft 26 by suitable means 34. Knob 25 forms no part of this invention.

The items delivered to hopper 16 by conveyor means 12 may be of varying length, so a barrier means 36 is adjustably mounted along the length of rod 38. Barrier means 36 is preferably a rigid arm mounted on block 40 that is adapted to slide along the length of rod 38. Counterclockwise rotation of handle 42 loosens a setscrew that secures block 40 to rod 38 so that barrier means 36 may be adjusted to any position along the length of rod 38. Clockwise rotation of handle 42 tightens said setscrew to lock block 40 and hence barrier means 36 into a position that accommodates the length of the items entering into the hopper.

Conveyor means 20 in the form of a spinning friction belt is relied upon to pull the lowermost item in the hopper from the stack of items in the hopper and to send such lowermost item in the direction indicated by said arrow 22.

A plurality of equidistantly spaced apart jostling members, collectively denoted 44 and individually denoted 44*a*, 44*b*, and 44*c*, are integrally formed with base plate 46 which is slideably mounted in overlying relation to floor plate 48 that forms the floor of hopper 16. In this illustrative embodiment, there are three jostling members as depicted, but that number is not critical and can be increased or decreased.

Figure 2:
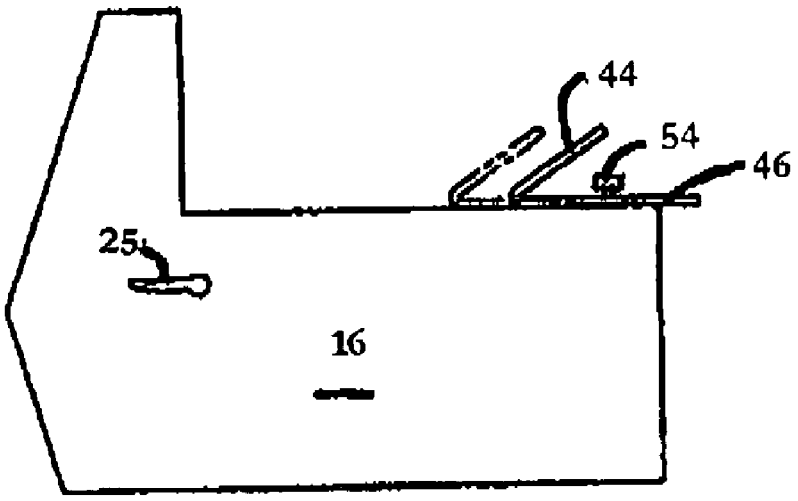
FIG. 2 is a side elevational view taken along line 2—2 in FIG. 1.

Each jostling member in this illustrated embodiment has a horizontal part formed integrally with base plate 46, as perhaps best understood in connection with FIG. 2, and an upwardly angled part that is positioned at approximately forty-five degrees (45°) relative to said horizontal part. The exact amount of the angle is not critical and the angle may vary widely from forty-five degrees (45°).

The jostling members need not have an angular shape nor must the angle be an acute angle as depicted. Although a forty-five degree (45°) angle as depicted works well, the angle could be changed to a different acute angle. Moreover, a ninety degree (90°) angle would also work. A wheel would also work if the axle thereof were positioned in the plane of base plate 46 or floor plate 48.

Central adjustment slot 50 is formed in floor plate 48 and enables base plate 46 and hence angle members 44 to be moved closer to conveyor belts 20 or further away therefrom, as indicated by double-headed directional arrow 52, thereby accommodating envelopes or other items of varying widths. Slot 50*a* formed in base plate 46 is in registration with central adjustment slot 50 and serves to increase the range of positions of said base plate 46 relative to floor plate 48.

Figure 3:
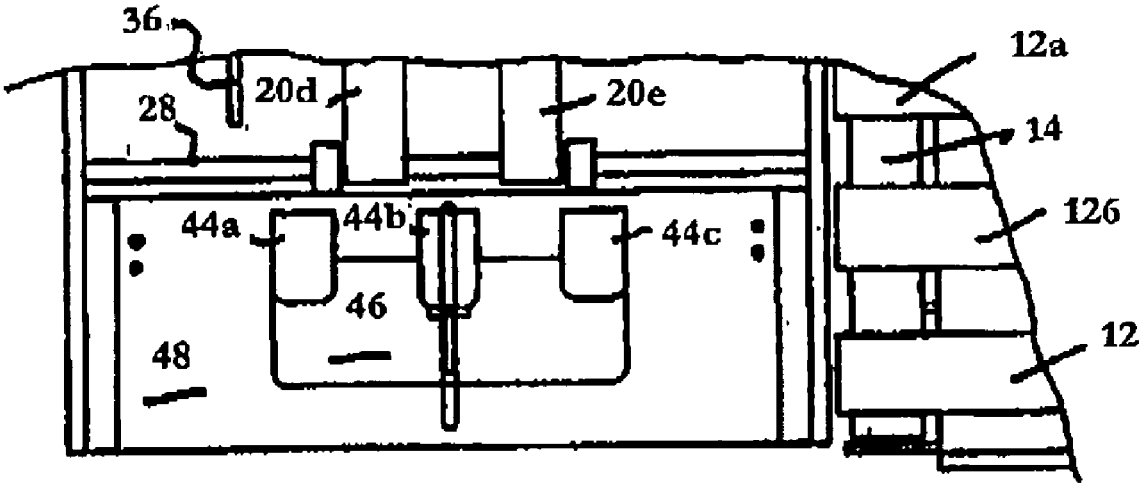
FIG. 3 is a detailed top plan view of the hopper.

As best understood in connection with FIG. 2, screw 54 when loosened enables base plate 46 and hence the jostling members to be repositioned to any part of slot 50 and when tightened secures said base plate 46 and jostling members 44*a*, 44*b*, 44*c* to said repositioned location. The dotted lines in FIG. 2 indicate this adjustability of the jostling members, but it should be understood that the extreme retracted and advanced positions of said jostling members are much further apart than FIG. 2 might suggest. For example, a very advanced position, suitable only for items of very narrow width, is depicted in FIG. 3.

In contrast with the wide range of movement for accommodating items of varying widths, the range of movement during oscillation of floor plate 48 and hence of base plate 46 and hence of angle members 44 is very small.

Figure 4:
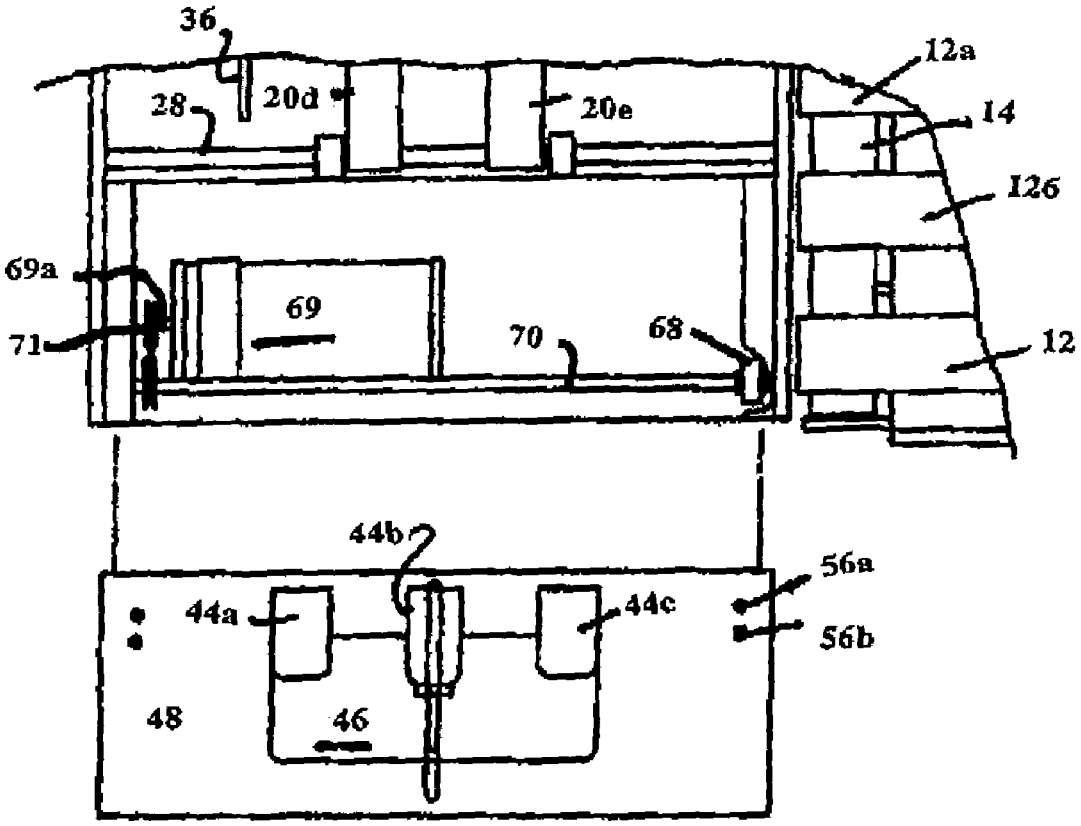
FIG. 4 is an exploded top plan view of the hopper.

As best understood in connection with FIG. 4, the oscillatory motion is provided by a motor 69 positioned below floor plate 48. The output shaft 69*a* of said motor is coupled by suitable means 71 to drive shaft 70 that carries cam 68.

Figure 5:
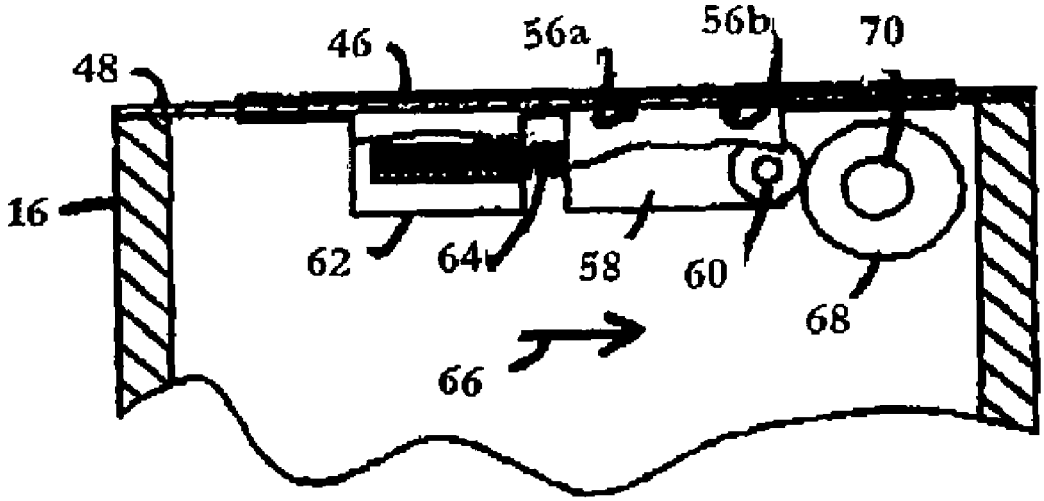
FIG. 5 is a partially sectional view taken along line 5—5 in FIG. 1.
Figure 6:
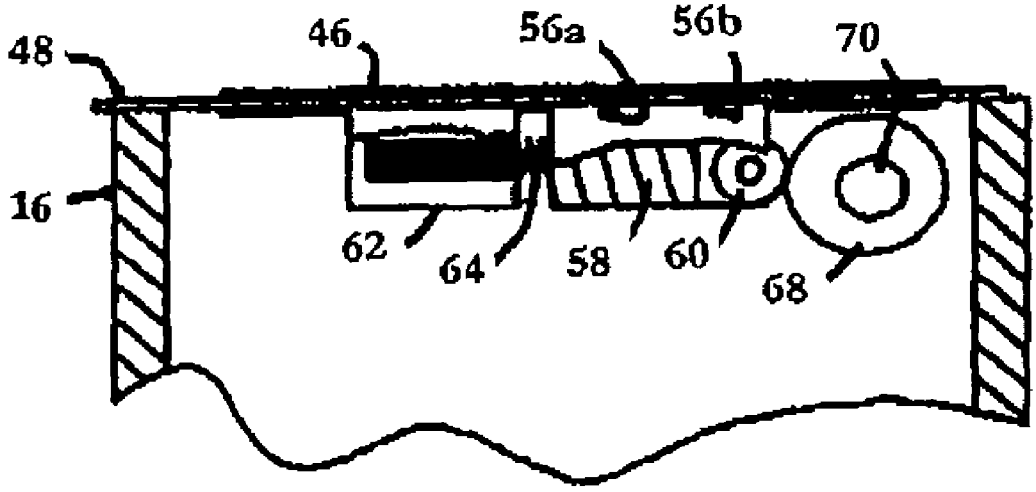
FIG. 6 is a view of the parts in FIG. 5 after the cam in FIG. 5 has rotated about one hundred eighty degrees (180°) about its axis of rotation.

As best understood in connection with FIGS. 5 and 6, base plate 46 and floor plate 48 are apertured to receive a pair of screws 56*a*, 56*b* that extend through said apertures into screw-threaded engagement with cam follower housing 58 that is fixedly secured by said screws to an underside of said floor plate 48. The trailing end of cam follower housing 58 is open so that cam follower 60 at least partially protrudes therefrom as depicted.

Spring housing 62 is fixedly secured to the underside of said floor plate 48 as well. Its leading end is closed and its trailing end is open to allow biasing means 64 to protrude therefrom as depicted. In this way, biasing means 64 urges cam follower housing 58 in the direction indicated by single-headed directional arrow 66. Accordingly, cam follower 60 is urged to bear against cam 68 as it rotates conjointly with shaft 70. The eccentric mounting of cam 68 on shaft 70 thus causes one complete oscillation of cam follower housing 58 and hence floor plate 48 secured thereto for each motor-driven rotation of shaft 70. Base plate 46 is fixedly secured to floor plate 48 as are jostling members 44 so said parts oscillate with floor plate 48.

Such oscillation of jostling members 44 taps the trailing edges of the items as they move downwardly in the hopper. Such tapping breaks the frictional bond between contiguous items, thereby reducing jamming and the downtime associated therewith. It also insures that the items will not stick to the walls of the hopper, thereby maintaining a uniform pressure on the means at the bottom of the hopper for removing items therefrom. The tapping also serves to stagger the sheets as they approach the separator.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

The invention claimed is:

1. An apparatus for breaking frictional bonds between contiguous items arranged in a substantially vertical stack in a hopper that is emptied from the bottom, comprising:

a floor plate for supporting said items in said hopper, said floor plate being disposed in a substantially horizontal plane and said floor plate having a leading edge and a trailing edge;

a base plate that overlies said floor plate and that is secured to said floor plate for conjoint movement therewith, said base plate having a leading edge and a trailing edge;

at least one jostling member secured to said base plate;

said at least one jostling member having a part adapted to tap against a trailing edge of said items;

oscillating means secured to said floor plate to cause said floor plate and hence said base plate and said at least one jostling member to oscillate in said substantially horizontal plane;

said at least one jostling member adapted to tap respective trailing ends of said items in said hopper so that said tapping prevents said items from becoming stuck in said hopper, thereby maintaining a constant pressure on said floor plate and so that said tapping breaks frictional bonds between said contiguous items;

a first conveyor means that delivers said items to said hopper along a first path of travel;

a second conveyor means that carries items from said hopper along a second path of travel disposed substantially ninety degrees (90°) to said first path of travel;

said leading edge and said trailing edge of said floor plate being substantially parallel to said first path of travel and substantially transverse to said second path of travel;

said oscillating means oscillating said floor plate in a direction substantially transverse to said first path of travel and substantially parallel to said second path of travel;

width adjusting means so that said hopper accommodates items of differing widths entering said hopper from said first conveyor means;

an elongate slot formed in said floor plate, said elongate slot being in substantially parallel relation to said second path of travel;

said at least one jostling member being mountable at any preselected location along the length of said elongate slot;

whereby said at least one jostling member is moved preselected distance toward said second conveyor means to accommodate items of relatively narrow width; and whereby said at least one jostling member is moved a preselected distance away from said second conveyor means to accommodate items of relatively wide width.

2. The apparatus of claim 1, further comprising:

an adjustably mounted barrier means that extends into said hopper in a direction transverse to said first path of travel so that said hopper may accommodate items of differing lengths.

3. The apparatus of claim 1, further comprising:

an elongate rod disposed in substantially parallel relation to said first path of travel;

a mounting block slideably mounted along the extent of said elongate rod;

a rigid barrier arm mounted to said block and extending from said block in substantially parallel relation to said second path of travel;

locking means for locking said mounting block at any preselected position along said extent of said elongate rod;

whereby said rigid barrier arm is moved a preselected distance toward said first conveyor means to accommodate items of relatively short extent; and whereby said rigid barrier arm is moved a preselected distance away from said first conveyor means to accommodate items of relatively long extent.

4. The apparatus of claim 1, wherein said oscillating means further comprises:

a biasing means housing fixedly secured to said floor plate, said biasing means housing having a closed end and an open end;

a biasing means disposed within said biasing means housing;

a cam follower housing fixedly secured to said floor plate;

said biasing means disposed in abutting relation to said cam follower housing and urging said cam follower housing away from said biasing means housing;

a cam follower rotatably mounted in said cam follower housing; a rotatably mounted drive shaft;

a cam eccentrically mounted to said drive shaft for conjoint rotation therewith;

said biasing means urging said cam follower into abutting relation to said cam;

whereby rotation of said cam effects oscillation of said cam follower housing and hence of said floor plate, said base plate and said at least one jostling member.

5. The apparatus of claim 1, said oscillating means further comprising:

said jostling member being provided in the form of an angle member;

said angle member having a horizontal part secured to said base plate; and said angle member having an angled part that projects upwardly from said leading end of said horizontal part at a predetermined angle.

6. The apparatus of claim 5, said oscillating means further comprising:

said predetermined angle being an acute angle.

7. The apparatus of claim 5, said oscillating means further comprising:

said predetermined angle being a right angle.

* * * * *